US005114436A

United States Patent [19]

Reid

[11] Patent Number: 5,114,436

[45] **Date of Patent: * May 19, 1992**

[54] PROCESS AND COMPOSITION FOR STABILIZED DISTILLATE FUEL OILS

[75] Inventor: Dwight K. Reid, Houston, Tex.

[73] Assignee: Betz Laboratories, Inc., Trevose, Pa.

[ * ] Notice: The portion of the term of this patent subsequent to Jun. 21, 2005 has been disclaimed.

[21] Appl. No.: 40,407

[22] Filed: Apr. 20, 1987

[51] Int. Cl.[5] ..... C10G 9/12

[52] U.S. Cl. ..... 44/385; 44/382; 44/410; 208/48 AA

[58] Field of Search ..... 44/76, 77, 57, 385; 208/48 AA

[56] References Cited

U.S. PATENT DOCUMENTS

| | | | |
|---|---|---|---|
| 2,256,187 | 9/1941 | Bartram | 44/375 |
| 2,261,227 | 11/1941 | Cloud | 44/382 |
| 2,904,416 | 9/1959 | Clarke et al. | 44/379 |
| 2,905,541 | 9/1959 | Gottshall et al. | 44/380 |
| 2,905,542 | 9/1959 | Gottshall et al. | 44/380 |
| 3,012,964 | 12/1961 | Pollitzer | 252/32.5 |
| 3,052,528 | 9/1962 | Graeme et al. | 44/76 |
| 3,115,465 | 12/1963 | Gruff et al. | 44/76 |
| 3,309,431 | 3/1967 | Mark et al. | 44/76 |
| 3,493,638 | 2/1970 | Meltsner | 44/76 |
| 3,558,470 | 1/1971 | Gillespie | 208/48 |
| 3,645,886 | 2/1972 | Gillespie et al. | 208/48 AA |
| 3,647,677 | 3/1972 | Wolff et al. | 208/48 AA |
| 3,658,706 | 4/1972 | Meltsner | 44/76 |
| 3,683,054 | 8/1972 | Wullensak et al. | 44/76 |
| 3,763,287 | 10/1973 | Chiddex et al. | 44/76 |
| 3,807,974 | 4/1974 | Kerlly et al. | 44/76 |
| 4,024,048 | 5/1977 | Shell et al. | 208/48 AA |
| 4,024,049 | 5/1977 | Shell et al. | 208/48 AA |
| 4,024,050 | 5/1977 | Shell et al. | 208/48 AA |
| 4,177,768 | 12/1979 | Davis | 44/76 |
| 4,248,182 | 2/1981 | Malec | 44/57 |
| 4,396,398 | 8/1983 | Knight | 44/77 |
| 4,752,374 | 6/1988 | Reid | 208/48 AA |

*Primary Examiner*—Robert Kunemund
*Assistant Examiner*—Ken Horton
*Attorney, Agent, or Firm*—Alexander D. Ricci; Gregory M. Hill

[57] ABSTRACT

This invention relates to processes and compositions for stabilizing distillate fuel oil which comprises adding to the distillate fuel oil an effective stabilizing amount of a mixture of (a) a phosphite compound having the formula

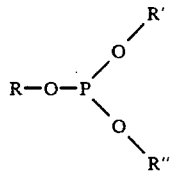

wherein R, R' and R'' are the same or different and are alkyl, aryl, alkaryl or aralkyl groups, and (b) an effective carboxylic acid having from 2 to about 20 carbon atoms, wherein the weight ratio of (a):(b) is from about 1:5 to aboug 1000:1.

23 Claims, No Drawings

PROCESS AND COMPOSITION FOR STABILIZED DISTILLATE FUEL OILS

BACKGROUND OF THE INVENTION

1. Field of the Invention

This invention relates to stabilized distillate fuel oils. More particularly, this invention relates to inhibiting color deterioration and particulate formation in distillate fuel oils, such as diesel fuel.

2. Description of the Prior Art

Various middle distillate fuel oils, such as diesel fuel and kerosene, tend to deteriorate with time. This deterioration usually results in the formation of sediment, sludge, or gum and objectionable color deterioration. Sediment formation may cause clogging of fuel system equipment such as filters, screens, nozzles, burners and other associated equipment. Discoloration of distillate fuel oils is objectionable for various reasons, including customer's preference for light colored fuel oils because discoloration may indicate that deterioration has occurred.

Suggestions of the prior art for stabilizing fuel oils include U.S. Pat. No. 2,256,187, Bartram, which discloses the use of a condensation product of a phosphorous halide and an organic hydroxyl containing compound, with the preferred class of materials comprising esters of phosphorous acids, to increase the stability of a relatively unstable oil product. Also, U.S. Pat. No. 2,261,227, Cloud, discloses the use of certain organic phosphites as stabilizing ignition promoters of diesel fuel. U.S. Pat. No. 2,943,924, Kukin, discloses fuel oil compositions obtained by incorporating in a mixture of certain catalytically cracked and straight-run distillate fuel oils a sludge inhibiting amount of a combination of (a) a certain monocarboxylic acid, and (b) a certain alkaline earth metal salt of an alkylbenzene sulfonic acid. U.S. Pat. No. 2,993,766, Fowler, teaches that the tendency of aviation gas turbine fuels to deposit carbonaceous matter at elevated temperatures may be inhibited by the presence of naphthenic acids in proportions above 0.1% based on the total fraction.

However, none of these prior art references disclose the unique and effective mixture of a phosphite compound and a carboxylic acid in accordance with the instant invention for inhibiting the color degradation and particulate formation of distillate fuel oils.

SUMMARY OF THE INVENTION

This invention relates to processes for stabilizing distillate fuel oil which comprises adding to the distillate fuel oil an effective stabilizing amount of a mixture of (a) a phosphite compound having the formula

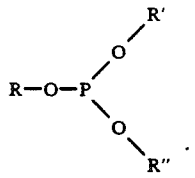

wherein R, R' and R'' are the same or different and are alkyl, aryl, alkaryl or aralkyl groups, and (b) a carboxylic acid having from 2 to about 20 carbon atoms, wherein the weight ratio of (a):(b) is from about 1:5 to about 1000:1. This invention also relates to stabilized distillate fuel oil compositions comprising distillate fuel oil and an effective stabilizing amount of (a) and (b) as defined above, wherein the ratio of (a):(b) is from about 1:5 to about 1000:1. More particularly, the processes and compositions of this invention relate to inhibiting particulate formation and color deterioration of distillate fuel oils. Generally, the total amount of the mixture of (a) and (b) is from about 1.0 parts to about 10,000 parts per million parts of the fuel oil. It is preferred that the weight ratio of (a):(b) is from about 1:1 to about 200:1. This mixture of (a) and (b) provides an unexpectedly higher degree of stabilization of distillate fuel oils than the individual ingredients comprising the mixture. It is therefore possible to produce a more effective stabilizing composition and process than is obtainable by the use of each ingredient alone. Because of the enhanced stabilizing activity of the mixture, the concentrations of each of the ingredients may be lowered and the total amount of (a) and (b) required for an effective stabilizing treatment may be reduced.

Accordingly, it is an object of the present invention to provide processes and compositions for stabilizing distillate fuel oils. It is another object of this invention to inhibit particulate formation in distillate fuel oils. It is a further object of this invention to inhibit color deterioration of distillate fuel oils. These and other objects and advantages of the present invention will be apparent to those skilled in the art upon reference to the following description of the preferred embodiments.

DESCRIPTION OF THE PREFERRED EMBODIMENTS

The present invention pertains to a process for stabilizing distillate fuel oil having hydrocarbon components distilling from about 300° F. to about 800° F., which comprises adding to the distillate fuel oil an effective stabilizing amount of a mixture of (a) a phosphite compound having the formula

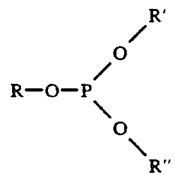

wherein R, R' and R'' are the same or different and are alkyl, aryl, alkaryl or aralkyl groups, and (b) a effective carboxylic acid having from 2 to about 20 carbon atoms, wherein the weight ratio of (a):(b) is from about 1:5 to about 1000:1. The amounts or concentrations of the two components of this invention can vary depending on, among other thing$, the tendency of the distillate fuel oil to undergo deterioration or, more specifically, to form particulate matter and/or discolor. While, from the disclosure of this invention, it would be within the capability of those skilled in the art to find by simple experimentation the optimum amounts or concentration of (a) and (b) for any particular distillate fuel oil, generally the total amount of the mixture of (a) and (b) which is added to the distillate fuel oil is from about 1.0 part to about 10,000 parts per million parts of the distillate fuel oil. Preferably, the mixture of (a) and (b) is added in an amount from about 1.0 part to about 1500 parts per million. It is also preferred that the weight ratio of (a):(b) is from about 1:1 to about 200:1, based on the total combined weight of these two components. Most preferably, the weight ratio of (a):(b) is about 20:1 based on the total combined weight of these two components.

The two components, (a) and (b), can be added to the distillate fuel oil by any conventional method. The two components can be added to the distillate fuel oil as a single mixture containing both compounds or the individual components can be added separately or in any other desired combination. The mixture may be added either as a concentrate or as a solution using a suitable carrier solvent which is compatible with the components and distillate fuel oil. The mixture can also be added at ambient temperature and pressure to stabilize the distillate fuel oil during storage. The mixture is preferably added to the distillate fuel oil prior to any appreciable deterioration of the fuel oil as this will either eliminate deterioration or effectively reduce the formation of particulate matter and/or color deterioration. However, the mixture is also effective even after some deterioration has occurred.

The present invention also pertains to a stabilized distillate fuel oil composition comprising a major portion of distillate fuel oil, such as blended diesel fuel, and a minor portion of an effective stabilizing amount of (a) a phosphite compound having the formula

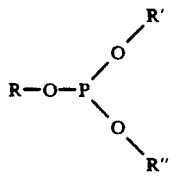

wherein R, R' and R'' are the same or different and are alkyl, aryl, alkaryl or aralkyl groups, and (b) a effective carboxylic acid having from 2 to about 20 carbon atoms, wherein the weight ratio of (a):(b) is from about 1:5 to about 1000:1. Generally, the total amount of (a) and (b) is from about 1.0 part to about 10,000 parts per million parts of the distillate fuel oil and, preferably, the total amount of (a) and (b) is from about 1.0 part to about 1500 parts per million parts of the distillate fuel oil. It is also preferred that the weight ratio of (a):(b) is from about 1:1 to about 200:1 based on the total combined weight of the these two components and, most preferably, the weight ratio of (a):(b) is about 20:1 based on the total combined weight of these two components.

The alkyl, aryl, alkaryl or aralkyl groups of the phosphite compound of this invention may be straight or branch-chain groups. Preferably, the alkyl, aryl, alkaryl and aralkyl groups have 1 to about 20 carbon atoms and, most preferably, these groups have from 2 to about 10 carbon atoms. Examples of suitable phosphite compounds include: triethylphosphite, triisopropylphosphite, triphenylphosphite, ethylhexyldiphenylphosphite, triisooctylphosphite, heptakis (dipropylene glycol) triphosphite, triisodecylphosphite, tristearylphosphite, trisnonylphenylphosphite, trilaurylphosphite, distearylpentaerythritoldiphosphite, dinonylisodecylphosphite, diphenylisooctylphosphite, diisooctyloctylphenylphosphite and diisodecylpentaerythritolphosphite. Preferably, the phosphite compound is selected from the group consisting of triethylphosphite, triphenylphosphite, ethylhexyldiphenylphosphite, triisooctylphosphite, and heptakis (dipropylene glycol) triphosphite.

The carboxylic acid component of this invention has from 2 to about 20 carbon atoms and, preferably, has from 2 to about 10 carbon atoms. The carboxylic acid may be straight or branch-chain, but it is preferred that the carboxylic acid is straight chain. The carboxylic acid may be saturated or unsaturated and may have one or more carboxyl groups as a constituent. It may also be monobasic, dibasic, tribasic, aromatic or heterocyclic and these acids may contain the following groups: alkyl, aryl, alkaryl, aralkyl, hydroxy, and the like. Nevertheless, it should be noted that the carboxyl group is the essential part of the acid utilized in accordance with this invention. Examples of suitable carboxylic acids include: acetic acid, hydroxyacetic acid, pelargonic acid, 2-ethylhexanoic acid, oleic acid, butyric acid, propionic acid, hexanoic acid, pentanoic acid, benzoic acid, valeric acid, caproic acid, caprylic acid, phenylacetic acid, palmitic acid, and phthalic acid. Preferably, the carboxylic acid is selected from the group consisting of acetic acid, hydroxyacetic acid, pelargonic acid, 2-ethylhexanoic acid and oleic acid. Most preferably, the carboxylic acid is acetic acid.

The distillate fuel oils of this invention are those fuel oils having hydrocarbon components distilling from about 300° F. to about 800° F., such as kerosene, jet fuel and diesel fuel. Included are straight-run fuel oils, thermally cracked, catalytically cracked, thermally reformed, and catalytically reformed oil stocks, and blends thereof which are susceptible to deterioration. Preferably, the distillate fuel oil is a blend or mixture of diesel fuels which consists of three components: (1) light cycle oil (LCO), (2) straight-run diesel (STRD), and (3) kerosene. Generally, STRD and kerosene have fewer stability problems. LCO's, although less stable, are still acceptable as fuels. However, when the three constituents are blended together, the final diesel fuel product can become unstable. Additionally, some thermally cracked fuel blends can be quite unstable if the process crude stream contains high levels of naturally occurring nitrogen and sulfur compounds.

The processes and compositions of the instant invention effectively stabilize the distillate fuel oils, particularly during storage. The term "stabilized" as used herein means that particulate formation in the distillate fuel oil and color deterioration of the distillate fuel oil are inhibited. The term "particulate formation" is meant to include the formation of soluble solids, sediment and gum.

In order to more clearly illustrate this invention, the data set forth below was developed. The following examples are included as being illustrations of the invention and should not be construed as limiting the scope thereof.

EXAMPLES

There are several accelerated test methods that are used by refineries for determining the stability of diesel fuels. Some of the most widely accepted test methods are the 110° F. dark storage test (one week to three months), DuPont F21-61, UOP test method 413, 80° C. test, and the 216° F. test. It was observed that some diesel fuels respond positively to selected chemical additives under specific conditions. In some cases, additives that were effective under accelerated test conditions (e.g., 216° F., 300° F.), were occasionally found to perform poorly under the more moderate 110° F. test. This observation agrees with those found in the recent literature. See Stavinoha, L. L., et al., *Accelerated Stability Test Techniques for Diesel Fuels*, October, 1980. Stability data obtained using the 216° F. or 300° F. accelerated tests are considered to be only qualitative indicators of the performance expectations of an additive under the highly regarded 110° F. storage test condition. It is widely accepted among researchers that seven days at 110° F. is equivalent to one month's storage at 72° F. Although the results of the 110° F. dark storage test are generally accepted as the only valid data in correlating data from these conditions to those from actual storage, some current manufacturers continue to rely on stability data from the more accelerated conditions.

Tests were conducted to determine the effect of the components to inhibit both color deterioration and solids formation of a diesel fuel containing 30% light cycle oil, 45.5% straight-run diesel and 24.5% kerosene, using the 90 minute, 300° F. accelerated test method. 50 mL of the diesel fuel sample spiked with the appropriate treatment was filtered through a Whatman No. 1 filter paper and into a test tube. The test tube was then supported in an oil bath maintained at 300°±2° F. The bath oil level was kept above the sample level in the test tube. After 90 minutes, the test tube was removed from the oil bath and stored at room temperature for another 90 minutes. The sample was then filtered through a clean Whatman No. 1 filter paper with moderate vacuum. After the filter paper appeared dry, the test tube was washed with mixed hexanes and the washings were transferred to the filter. The washing and transferring steps were repeated once more. Then all traces of the oil were removed from the filter paper by washing it with a stream of mixed hexanes from a wash bottle. The vacuum was maintained until the filter paper was dry. The filter paper was thereafter transferred to a reflectometer where the percent reflectance of the sample was measured. The color of the sample was determined by visual comparison with known standards according to the ASTM-D-1500 procedure, which involved matching the color of the fuel samples with ASTM-1500 color numbers. The results are based on a scale of 0.5 to 8.0 wherein increasing values indicate increasing darkness of the sample. The sediment produced with each sample was also measured. The results obtained are reported in Table I below.

TABLE I

| Sample Description | Sediment Level mg/100 mL | Color Level* ASTM D1500 |
|---|---|---|
| Set 1: | | |
| Untreated | 1.2 | 1.8 |
| Untreated | 1.2 | 2.0 |
| Acetic Acid, 2.5 ppm | 1.8 | 1.8 |
| 2-Ethylhexanoic Acid, 2.5 ppm | 1.4 | 2.0 |
| Set 2: | | |
| Untreated | 1.6 | 3.0 |
| Untreated | 1.2 | 2.8 |
| Triphenylphosphite, 50 ppm | 2.0 | 2.0 |
| Heptakis (dipropylene glycol) triphosphite, 50 ppm | 1.4 | 2.0 |
| Heptakis (dipropylene glycol) triphosphite, 50 ppm | 1.6 | 2.3 |
| Triisooctylphosphite, 50 ppm | 1.2 | 2.8 |
| 2-Ethylhexanoic Acid, 5 ppm | 4.2 | 2.8 |
| Heptakis (dipropylene glycol) triphosphite, 50 ppm and 2-ethylhexanoic acid, 5 ppm | 0.8 | 2.8 |
| Set 3: | | |
| Untreated | 1.4 | 4.3 |
| Triphenylphosphite, 50 ppm and acetic acid, 2.5 ppm | 0.4 | 2.5 |
| Heptakis (dipropylene glycol) triphosphite, 50 ppm and acetic acid, 2.5 ppm | 0.4 | 1.8 |
| Triisooctylphosphite, 50 ppm and acetic acid, 2.5 ppm | 1.0 | 2.0 |

*Note: The difference in the color level of the untreated sample from Sets 1 to 3 is believed to be due to the effects of standing prior to experimentation.

The results reported in Table I demonstrate the unique and exceptionally effective relationship of the components of this invention since the samples containing both the phosphite compound and carboxylic acid show better overall effectiveness in stabilizing the diesel fuel (inhibiting both color degradation and sediment formation) than was obtainable in using each of the components individually.

Further tests were conducted to determine the effect of the components of this invention to inhibit both color and sediment formation of a diesel fuel sample from a Midwestern refinery containing 25% light cycle oil with the balance being straight-run diesel and kerosene using a seven-day heating period at 175° F. to accelerate degradation. The results obtained are reported in Table II below.

TABLE II

| Sample Description | Sediment Level mg/100 mL | Color Level ASTM D1500 |
|---|---|---|
| Untreated | 10.2 | 3.0 |
| Triethylphosphite, 50 ppm and acetic acid, 2.5 ppm | 1.2 | 2.2 |
| Triisooctylphosphite, 50 ppm and acetic acid, 2.5 ppm | 1.2 | 2.4 |

The results reported in Table II demonstrate the superior efficacy of the phosphite/carboxylic acid combination of this invention.

Additional tests were conducted to study the effect of the phosphite compounds and carboxylic acids to inhibit color deterioration of a diesel fuel sample from a Midwestern refinery containing 20% light cycle oil with the balance being straight-run diesel and kerosene using a twelve-week heating period at 110° F. to accelerate degradation. The results obtained are reported in Table III below.

TABLE III

| Sample Description | Concentration of Additive, ppm | Color Level ASTM D1500 |
|---|---|---|
| Untreated | — | 3.3 |
| Triisooctylphosphite/Acetic Acid | 380/20 | 1.8 |
| | 285/15 | 1.8 |
| | 190/10 | 1.5 |
| | 95/5 | 1.8 |
| Triphenylphosphite/Acetic Acid | 380/20 | 2.5 |
| | 285/15 | 2.3 |
| | 190/10 | 1.0 |
| | 95/5 | 2.0 |
| Ethylhexyldiphenylphosphite/Acetic Acid | 380/20 | 2.0 |
| | 285/15 | 1.8 |
| | 190/10 | 1.5 |
| | 95/5 | 2.5 |
| Triethylphosphite/Acetic Acid | 380/20 | 2.5 |
| | 285/15 | 1.8 |
| | 190/10 | 1.5 |
| | 95/5 | 1.5 |
| UOP-130 (believed to be an amine based dispersant) | 400 | 5.5 |
| FOA-3 (believed to be a cyclo-alkyl amine) from DuPont | 400 | 3.5 |

The results reported in Table III further demonstrate the substantial efficacy of the phosphite/carboxylic acid combination of this invention for color stability and also show that the instant invention is superior to two other commercially available distillate fuel stabilizers.

Tests were conducted to further study the effect of phosphites and phosphite/carboxylic acid mixture to inhibit both color degradation and sediment formation of a diesel fuel sample from a Midwestern refinery containing 20%-30% light cycle oil with the balance being straight-run diesel and kerosene using a twelve-week heating period at 110° F. to accelerate degradation. The results obtained are reported in Table IV below.

TABLE IV

| Sample Description | Sediment Level ppm | Color Level ASTM D1500 |
|---|---|---|
| 20% LCO: Untreated | 2.4 | 4.0 |
| Triethylphosphite, 300 ppm | 4.0 | 3.2 |
| Triethylphosphite/acetic acid at 105/20 ppm | 0.8 | 3.5 |
| Triethylphosphite/acetic acid at 250/50 ppm | 1.2 | 3.5 |

The results reported in Table IV also indicate that the carboxylic acids, when combined with the phosphites, effectively inhibit sediment formation and color degradation.

Tests were also conducted to study the effect of various additives to inhibit color degradation and sediment formation of a diesel fuel sample from a Midwestern refinery containing 20% light cycle oil with the balance being straight-run diesel and kerosene using a seven-day heating period at 175° F. to accelerate degradation. The results obtained are reported in Table V below.

TABLE V

| Sample Description | Active Concentration, ppm | Sediment Level mg/100 mL | Color Level ASTM D1500 |
|---|---|---|---|
| Untreated | 0 | 1.0 | 1.8 |
| | 0 | 1.0 | 1.8 |
| Triisooctylphosphite/ acetic acid | 200/0 | 1.0 | 1.3 |
| | 400/0 | 2.8 | 1.3 |
| | 600/0 | 3.8 | 1.3 |
| | 190/10 | 0.6 | 1.3 |
| | 380/20 | 1.2 | 1.3 |
| | 570/30 | 0.8 | 1.5 |
| | 167/33 | 1.4 | 1.5 |
| | 333/67 | 2.0 | 1.8 |
| | 500/100 | 1.8 | 2.0 |
| Ethylhexyldiphenyl-phosphite/acetic acid | 190/10 | 0.8 | 1.3 |
| | 380/20 | 0.4 | 1.5 |
| | 570/30 | 0.4 | 1.8 |
| | 167/33 | 0.6 | 1.8 |
| | 333/67 | 1.2 | 1.8 |
| | 500/100 | 0.4 | 1.8 |
| Triisooctylphosphite/ nonanoic acid/a phenolic dispersant | 361/19/20 | 1.2 | 1.3 |
| | 342/18/40 | 1.4 | 1.5 |

The results reported in Table V indicate that the phosphite/carboxylic acid mixture is effective at inhibiting sediment formation and color deterioration.

Tests were conducted to study color degradation and sediment formation of a diesel fuel from a Midwestern refinery containing 20% light cycle oil with the balance being straight-run diesel and kerosene using an eighty-eight hour heating period at 210° F. to accelerate degradation (UOP-413 Test). The results obtained are reported in Table VI below.

TABLE VI

| Sample Description | Active Concentration, ppm | Sediment Level mg/100 mL | Color Level ASTM D1500 |
|---|---|---|---|
| Untreated | 0 | 0.3 | not recorded |
| | 0 | 0.3 | not recorded |
| Triisooctylphosphite/ pelargonic acid | 285/15 | 0.4 | not recorded |
| | 285/15 | 0.4 | not recorded |

Test data have been reported without excluding any possible outlying values. It is believed that during experimentation possible errors in manipulating samples may have contributed to this unfavorable result.

Tests were conducted to study the effect of phosphites and phosphite/carboxylic acid mixture to inhibit sediment formation of a diesel fuel sample from a Mid-Atlantic Coast refinery containing 50% light cycle oil with the balance being straight-run diesel and kerosene using a twelve-week heating period at 110° F. to accelerate degradation. The results obtained are reported in Table VII below.

TABLE VII

| Sample Description | Concentration of Additive, ppm | Sediment Level mg/100 mL |
|---|---|---|
| Untreated | — | 2.4 |
| Untreated | — | 2.6 |
| Triphenylphosphite/acetic acid | 350/0 | 2.0 |
| | 333/67 | 1.8 |
| | 250/50 | 1.2 |
| | 167/33 | 1.0 |
| | 83/17 | 1.4 |
| Triisooctylphosphite/acetic acid | 350/0 | 3.4 |
| | 260/0 | 2.8 |
| | 100/0 | 2.4 |
| | 333/67 | 1.8 |
| | 250/50 | 2.4 |
| | 83/17 | 2.6 |
| Ethylhexyldiphenyl-phosphite/acetic acid | 333/67 | 1.4 |
| | 250/50 | 1.0 |
| | 167/33 | 0.6 |
| | 83/17 | 2.8 |
| Ethylhexyldiphenyl-phosphite/2-ethylhexanoic acid | 333/67 | 3.4 |
| | 250/50 | 3.0 |
| | 167/33 | 2.0 |
| | 83/17 | 2.4 |

The results reported in Table VII indicate the substantial efficacy. (with the exception of the last example) of the phosphite/carboxylic acid mixture to inhibit sediment formation. Test data have been reported without excluding any possible outlying values. It is believed that during experimentation possible errors in manipulating samples may have contributed to a few unfavorable results.

Additional tests were conducted to determine the effect of phosphites and phosphite/carboxylic acid mixture to inhibit color degradation and sediment formation of a diesel fuel sample from a Mid-Atlantic Coast refinery containing 50% light cycle oil with the balance being straight-run diesel and kerosene using a seven-day heating period at 175° F. to accelerate degradation. The results obtained are reported in Table VIII below.

TABLE VIII

| Sample Description | Concentration of Additive, ppm | Sediment Level mg/100 mL | Color Level ASTM D1500 |
|---|---|---|---|
| Untreated | — | 2.5 | 3.0 |
| Untreated | — | 2.6 | 3.2 |
| Ethylhexyldiphenyl-phosphite/acetic acid | 350/0 | 2.2 | 1.5 |
| | 333/67 | 0.8 | 1.8 |
| | 250/50 | 1.0 | 2.0 |

TABLE VIII-continued

| Sample Description | Concentration of Additive, ppm | Sediment Level mg/100 mL | Color Level ASTM D1500 |
|---|---|---|---|
| Triphenylphosphite/ acetic acid | 350/0 | 2.6 | 2.0 |
| | 167/33 | 1.0 | 2.0 |
| | 83/17 | 1.2 | 1.8 |

The results reported in Table VIII reveal that the phosphites, when used alone, were able to provide some stabilization of the fuel's color, but they failed to effectively inhibit sediment formation. However, the phosphite/carboxylic acid mixture effectively inhibited both the degradation of color and sediment formation.

Further tests were conducted to study the effect of phosphites and phosphite/carboxylic acid mixture to inhibit color degradation and sediment formation of a diesel fuel sample from a Southern refinery containing 18% light cycle oil with the balance being straight-run diesel and kerosene using a twelve-week heating period at 110° F. to accelerate degradation. The results obtained are reported in Table IX below.

TABLE IX

| Sample Description | Sediment Level mg/100 mL | Color Level ASTM D1500 |
|---|---|---|
| Untreated | 7.8 | 4.5 |
| Triisooctylphosphite, 300 ppm | 2.8 | 4.3 |
| Triisooctylphosphite, 285 ppm and acetic acid, 15 ppm | 2.0 | 4.3 |

The results reported in Table IX show that the phosphite/carboxylic acid mixture was more effective in stabilizing the fuel sample than the phosphite when used alone.

Tests were conducted to determine the effect of various additives on the relative amount of sediment formed in a jet fuel from a West Coast refinery when heated at 385° F. for 22 hours as a 25/75 solution in heptane. 100 mL of the fuel was dosed with the appropriate additive. The mixture was then heated to reflux (385° F.) in air for 22 hours. A 25-mL aliquot of the refluxed material was thereafter mixed with 75 mL of heptane in a calibrated tube, the solid formed was centrifuged, and the amount of solid was then recorded. The results obtained are reported in Table X below.

TABLE X

| Additive | Concentration (ppm) | Relative Amount of Sediment |
|---|---|---|
| None (not heated) | — | <0.01 |
| None (heated 7 hours) | — | 0.04 |
| None (heated 22 hours) | — | 0.08[1] |
| $H_2SO_4$ (heated 7 hours) | 100 | 0.02 |
| Triisooctylphosphite | 50 | 0.04 |
| Triisooctylphosphite/acetic acid | 50/2.5 | 0.02 |

[1]Average of three measurements

Tests were also conducted to study the effect of various additives on the amount of gum formed in a furnace oil when heated at a temperature of 405° F. for 16 hours to accelerate degradation. The results obtained are reported in Table XI below.

TABLE XI

| Additive | Concentration (ppm) | Washed Gums (mg/50 mL) |
|---|---|---|
| None | — | 524 |
| | — | 654 |
| | — | 713 |
| | — | 622 |
| | Average: | 628 ± 79 |
| Acetic Acid | 35 | 636 |
| Ethylhexyldiphenylphosphite | 350 | 382 |
| Ethylhexyldiphenylphosphite/ | 100/17 | 195 |
| Acetic Acid | 350/100 | 378 |
| Ethylhexyldiphenylphosphite/ | 100/100 | 293 |
| Oleic Acid | 350/100 | 364 |
| Triisooctylphosphite/Acetic Acid | 100/100 | 400 |
| Triisooctylphosphite/Oleic Acid | 150/300 | 345 |
| Triphenylphosphite/Pelargonic Acid | 150/300 | 878 |

Finally, tests were conducted to study the effect of phosphites/carboxylic acids on the amount of gum formed in various fuels. The results obtained are reported in Table XII below.

TABLE XII

| | Fuel Description | Condition of Study | Additive | Concentration (ppm) | Washed Gums (mg/100 mLs) |
|---|---|---|---|---|---|
| (1) | Canadian Synfuel | Refluxed in air at 203° F. for 16 hours after 7 days' storage at room temperature | Ethylhexyldiphenylphosphite/acetic acid | 420/80 | 252 |
| | | | Untreated | — | 336 |
| (2) | Distilled Canadian Synfuel | Refluxed in air at 392° F. for 16 hours | Ethylhexyldiphenylphosphite/acetic acid | 420/80 | 96 |
| | | | | 840/160 | 134 |
| | | | Untreated | — | 145 |
| | | Refluxed in air at 392° F. for 16 hours after 14 days' storage at room temperature | Ethylhexyldiphenylphosphite/acetic acid | 420/80 | 154 |
| | | | Untreated | — | 238 |
| (3) | Distillate hydrotreater feedstock from a Western Refiner | Reflux in air at 248° F. for 16 hours | Ethylhexyldiphenylphosphite/acetic acid | 252/48 | 26 |
| | | | Untreated | — | 52 |
| (4) | Same as 3 but from a different unit | Same as 3 | Ethylhexyldiphenylphosphite/acetic acid | 168/32 | 98 |
| | | | Untreated | — | 400 |

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

What is claimed is:

1. A process for stabilizing distillate fuel oil which comprises adding to said fuel oil and effective stabilizing amount of a mixture of (a) a phosphite compound selected from the group consisting of triethylphosphite, triphenylphosphite, ethylhexyldiphenylphosphite and triisooctyl phosphite and (b) acetic acid, wherein the weight ratio of (a):(b) is from about 1:5 to about 1000:1.

2. The process of claim 1 wherein said mixture is added in an amount from about 1.0 part to about 10,000 parts per million parts of said fuel oil.

3. The process of claim 1 wherein said mixture is added at ambient temperature and pressure.

4. The process of claim 1 wherein said mixture is added to said fuel oil prior to deterioration of the fuel oil.

5. The process of claim 1 wherein the weight ratio of (a):(b) is from about 1:1 to about 200:1.

6. The process of claim 1 wherein the distillate fuel oil is a blended diesel fuel.

7. The process of claim 6 wherein said mixture is added in an amount from about 1.0 to about 1,500 parts per million parts of said fuel oil.

8. A stabilized distillate fuel oil composition comprising distillate fuel oil and an effective stabilizing amount of (a) a phosphite compound selected from the group consisting of triethylphosphite, triphenylphosphite, ethylhexyldiphenylphosphite and triisooctyl phosphite and (b) acetic acid wherein the weight ratio of (a):(b) is from about 1:5 to about 1000:1.

9. The composition of claim 8 wherein the total amount of (a) and (b) is from about 1.0 part to about 10,000 parts per million parts of said fuel oil.

10. The composition of claim 8 wherein the weight ratio of (a):(b) is from about 1:1 to about 200:1.

11. The composition of claim 8 wherein the distillate fuel oil is a blended diesel fuel.

12. The composition of claim 11 wherein said mixture is added in an amount from about 1.0 part to about 1,500 parts per million parts of said fuel oil.

13. A process for stabilizing distillate fuel oil which comprises adding to said fuel oil an effective stabilizing amount of a mixture of (a) heptakis (dipropylene glycol) triphosphite and (b) a carboxylic acid having from 2 to about 20 carbon atoms, wherein the weight ratio of (a):(b) is from about 1:5 to about 1000:1.

14. The process of claim 13 wherein said mixture is added in an amount from about 1.0 part to about 10,000 parts per million parts of said fuel oil.

15. The process of claim 13 wherein said mixture is at ambient temperature and pressure.

16. The process of claim 13 wherein said mixture is added to said fuel oil prior to deterioration of the fuel oil.

17. The process of claim 13 wherein said (b) carboxylic acid is selected from the group consisting of acetic acid, hydroxyacetic acid, pelargonic acid, 2-ethylhexanoic acid and oleic acid.

18. The process of claim 17 wherein the weight ratio of (a):(b) is from about 1:1 to about 200:1.

19. The process of claim 17 wherein the distillate fuel oil is a blended diesel fuel.

20. The process of claim 19 wherein said mixture is added in an amount from about 1.0 part to about 1,500 parts per mil lion parts of said fuel oil.

21. A stabilized distillate fuel oil composition comprising distillate fuel oil and an effective stabilizing amount of (a) heptakis (dipropylene glycol) triphosphite and (b) a carboxylic acid having from 2 to about 20 carbon atoms, wherein the weight ratio of (a):(b) is from about 1:5 to about 1000:1.

22. The composition of claim 21 wherein the total amount of (a) and (b) is from about 1.0 part to about 10,000 parts per million parts of said fuel oil.

23. The composition of claim 22 wherein said (b) carboxylic acid is selected from the group consisting of acetic acid, hydroxyacetic acid, pelargonic acid, 2-ethylhexanoic acid and oleic acid.

* * * * *